US008429945B2

(12) United States Patent
Cernuschi et al.

(10) Patent No.: US 8,429,945 B2
(45) Date of Patent: Apr. 30, 2013

(54) ROLLING PROCESS AND RELATING LONGITUDINAL, MULTI-STAND ROLLING MILL OF CONTINUOUS, RESTRAINED TYPE FOR HOLLOW BODIES

(75) Inventors: Ettore Cernuschi, Bareggio (IT); Mauro Lattanzi, Passo Corese (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 13/379,625

(22) PCT Filed: Jun. 29, 2010

(86) PCT No.: PCT/EP2010/059182

§ 371 (c)(1), (2), (4) Date: Dec. 20, 2011

(87) PCT Pub. No.: WO2011/000819

PCT Pub. Date: Jan. 6, 2011

(65) Prior Publication Data

US 2012/0103049 A1 May 3, 2012

(30) Foreign Application Priority Data

Jun. 29, 2009 (IT) ..... MI2009A1143

(51) Int. Cl.
*B21B 17/00* (2006.01)

(52) U.S. Cl.
USPC ..... 72/209

(58) Field of Classification Search ..... 72/96, 97, 72/208, 209, 250, 251
See application file for complete search history.

(56) References Cited

U.S. PATENT DOCUMENTS 4,037,449 A * 7/1977 Schuetz ..... 72/209
7,469,565 B2 * 12/2008 Nakaike et al. ..... 72/97

FOREIGN PATENT DOCUMENTS

| | | |
|---|---|---|
| DE | 2811801 | 9/1979 |
| EP | 1764167 | 3/2007 |
| EP | 1854561 | 11/2007 |
| WO | WO03057383 | 7/2003 |

* cited by examiner

*Primary Examiner* — Debra Sullivan
(74) *Attorney, Agent, or Firm* — Stetina Brunda Garred & Brucker

(57) ABSTRACT

A longitudinal, multi-stand rolling mill of the continuous, restrained type for rolling hollow bodies is described, which comprises a main rolling mill (2) and an extracting rolling mill (4) in line and downstream of the main rolling mill, at a distance from the main rolling mill larger than the maximum length of the hollow body and of the spindle, and in which the spindle is extracted at the outlet of the main rolling mill in the gap between said main rolling mill and extracting rolling mill, and is laterally unloaded.

3 Claims, 5 Drawing Sheets

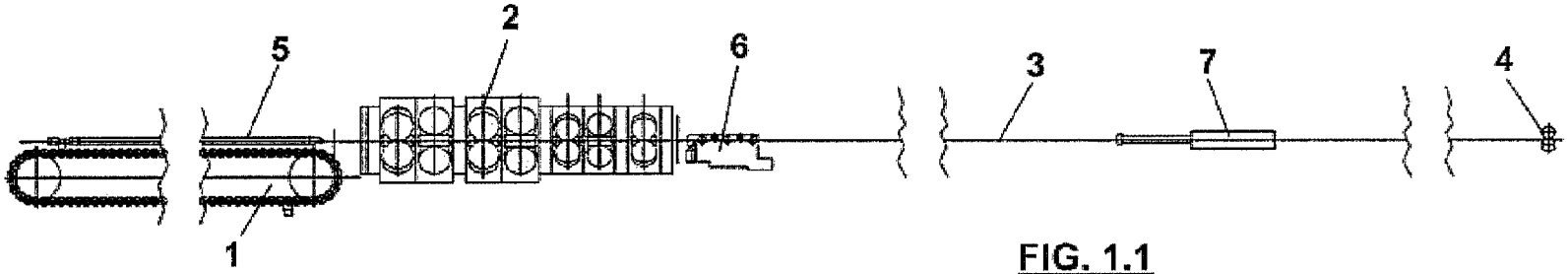
FIG. 1.1
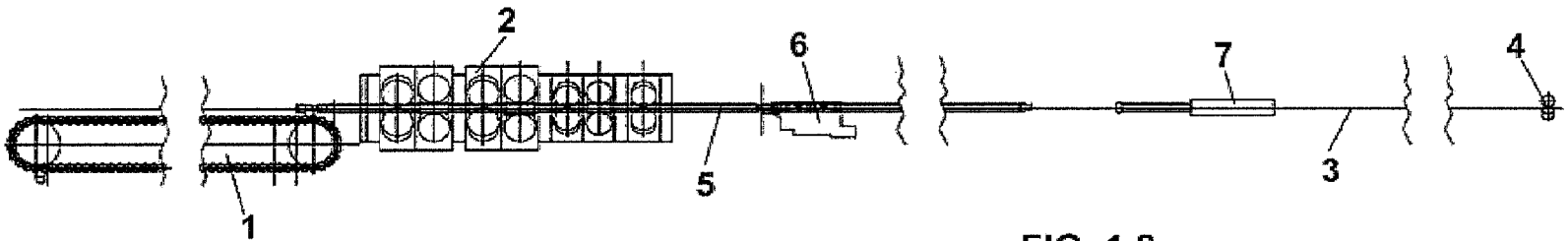
FIG. 1.2
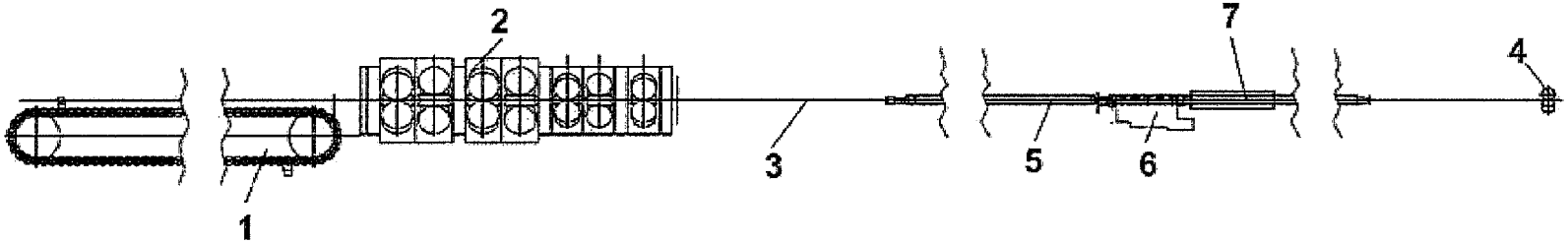
FIG. 1.3

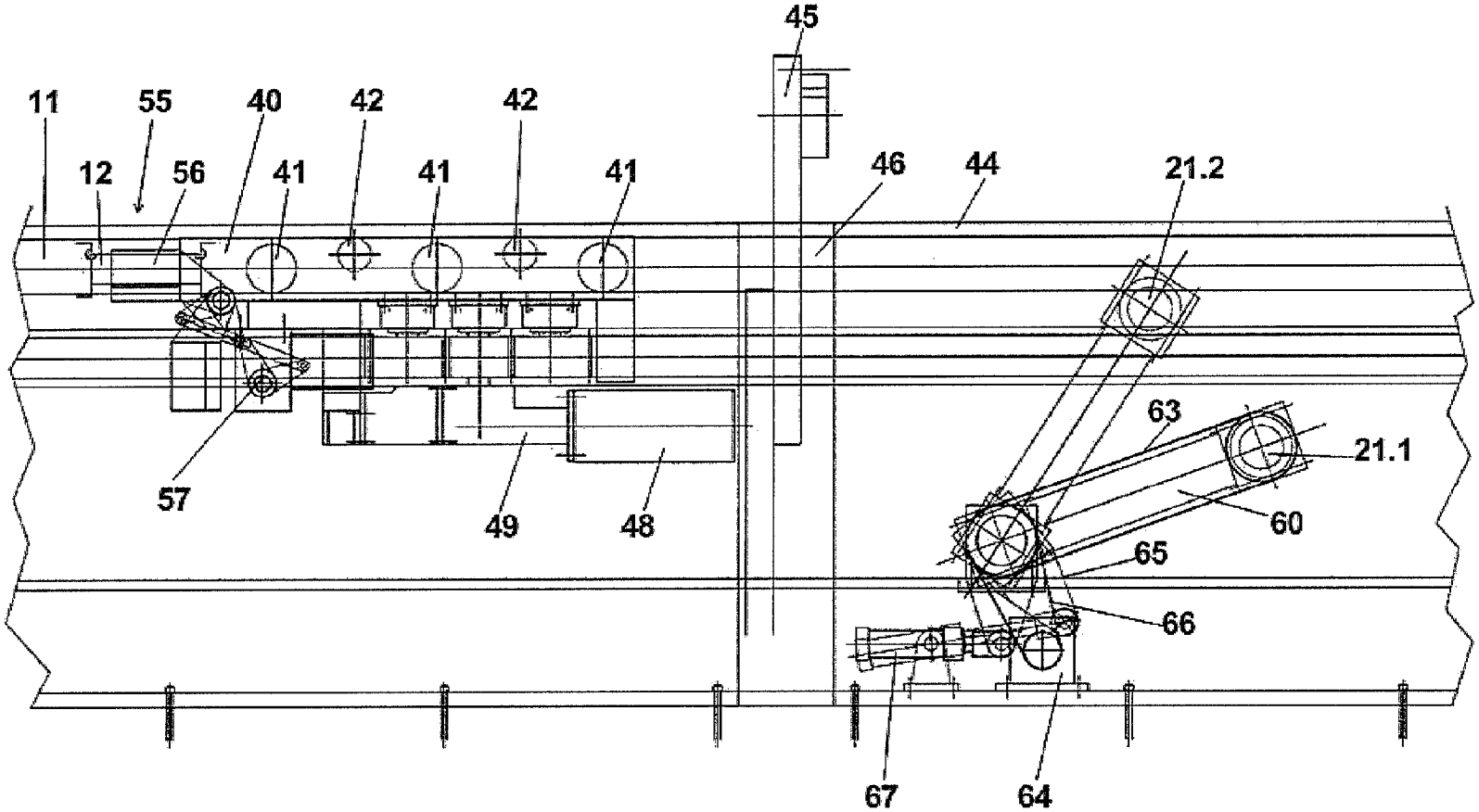
FIG. 4.1

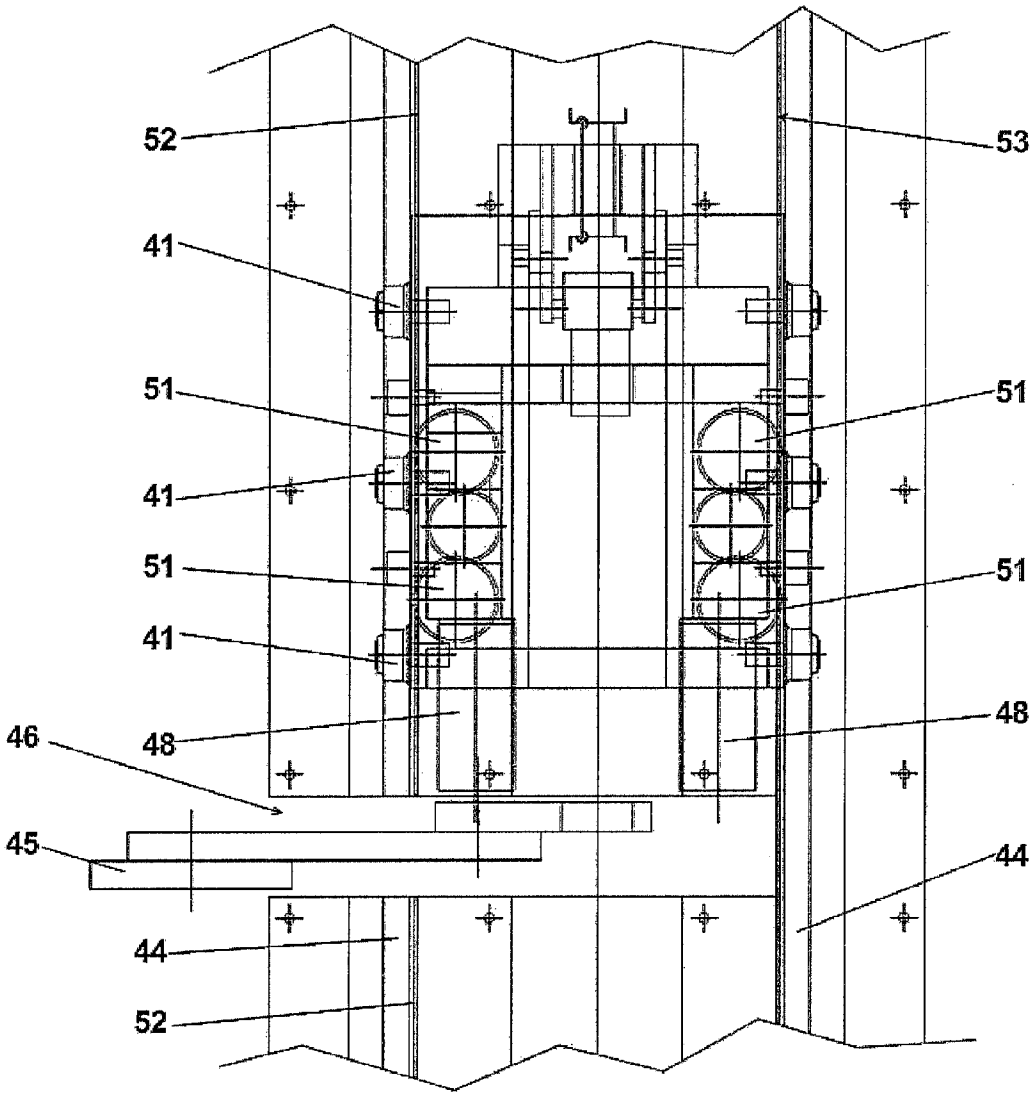
FIG. 4.2

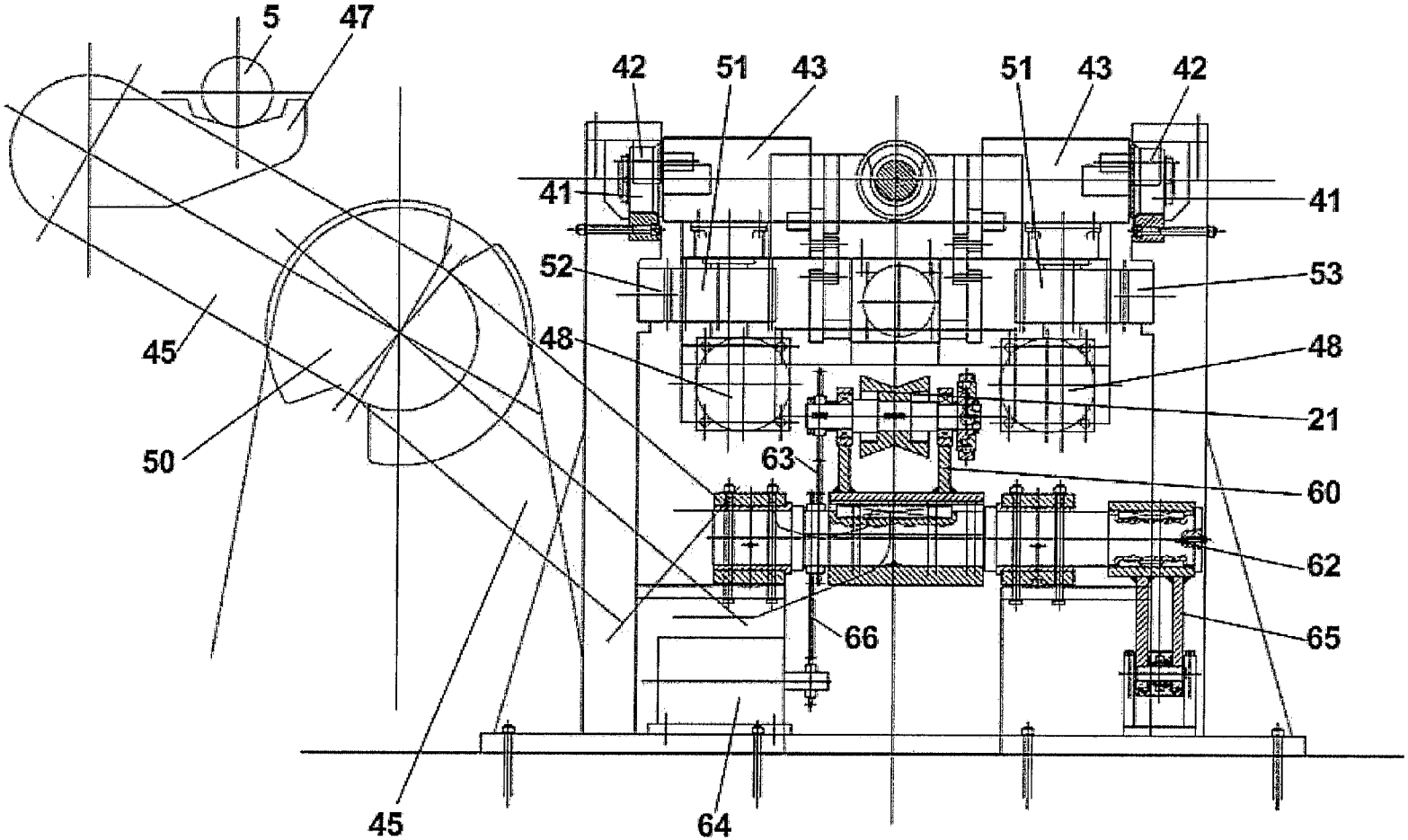
FIG. 4.3

ROLLING PROCESS AND RELATING LONGITUDINAL, MULTI-STAND ROLLING MILL OF CONTINUOUS, RESTRAINED TYPE FOR HOLLOW BODIES

FIELD OF APPLICATION OF THE INVENTION

The present invention relates to the field of longitudinal rolling mills for hollow bodies operating with internal tool, and more precisely to a rolling process and relating longitudinal, multi-stand rolling mill for hollow bodies operating on a spindle.

STATE OF THE ART

The longitudinal, multi-stand rolling mills of known type are divided in the following types, according to their morphology with particular regard to controlling the speed is and position of the spindle within the hollow body (pipe).

Floating Spindle Rolling Mill.

In so-called continuous rolling mills having a floating (free) spindle, the spindle may freely move within the pipe depending on the frictional forces which are generated, and therefore it naturally accelerates as the stands are sequentially engaged. The withdrawal of the spindle from the pipe occurs out of the rolling line. Very short cycle times and thus high productivity, e.g. 4-5 pieces per minute, are obtained.

In contrast, this type of rolling mill is subject to various drawbacks.

The spindle acceleration causes states of compression in the pipe, damaging to the size quality and the defectiveness of the pipes as the throat delimited by the rolling rollers is clogged (known state of "overfilling") in the first stands and is choked (known state of "underfilling") on the finishing stands.

There are problems of rolling stability and of excessive tolerances: the pipe cooling is not uniform over the length: the head part where there is no spindle remains hot longer, while the back part where the spindle is still inserted, is partially cooled down by the spindle itself, therefore a fossil furnace is normally required downstream to render the temperature of the pipe uniform before the final rolling required to calibrate or reduce the diameter of the pipe. The extraction of the spindle from the pipe generally occurs out of the rolling line.

Semi-Restrained Spindle Rolling Mill.

It is the evolution of the rolling mill having a floating spindle: the spindle is restrained at the technologically favourable speed when rolling, while the spindle is released by the restraining system and remains within the pipe itself at the end of rolling, once the tail of the pipe has left the last stand. The withdrawal of the spindle from the pipe occurs out of the rolling line.

Short cycle times and thus high productivity, e.g. 3-4 pieces per minute, are obtained.

In contrast, equivalent problems are found as in the preceding case, in terms of pipe temperature non-uniformity.

Restrained Spindle Rolling Mill.

It is characterized by a rack and pinion restraining system. At end of rolling, when is the tail of the pipe leaves the last stand, the pipe is engaged downstream in a rolling mill of extracting type, operating on the outer diameter of the pipe, which pulls the pipe forward, while the restraining system blocks the spindle and pulls it back towards the inlet side of the rolling mill where it is then unloaded. Cycle times are higher and therefore less productivity as compared to the preceding types is obtained: 2 pieces per minute.

The limit of this technology is thus related to the productivity, in particular for rolling mills for small and medium pipes, e.g. with a diameter less than or equal to 7" (177.8 mm).

Restrained Spindle Rolling Mill with Pipe Extractor and Release at End of Rolling, with the Spindle Passing in the Extractor.

It provides for the spindle being stopped by the restraining system at the end of rolling, the pipe being withdrawn from the spindle by means of the extracting rolling mill and being then released by the restraining system, moved forward by means of pressure rollers, passed through the extractor and unloaded downstream from the extractor itself. Relatively short cycle times: 2.5 pieces per minute.

This type of solution includes dragging the hot spindle by means of pressure rollers with risk of damaging the surface itself.

However, passing the spindle through the extracting rolling mill also requires a stand solution which may be quickly and precisely opened and closed, with a risk of misaligning the edges of the two adjacent rollers and therefore longitudinally marking the pipe.

Moreover, the rolling mills of longitudinal type are generally characterized by other factors such as:

the number of rollers per stand (generally 2 or 3);

the possibility of loading or not the pipe on inlet side with the spindle being pre-inserted or not, in this case by providing for the spindle being inserted in line;

the presence or absence of pipe calibrating stands upstream of the first stand;

the presence or absence of rounding stands downstream of the last stand, which roll between rollers and spindle. Normally this type of stand is present if the spindle is withdrawn out of the line.

SUMMARY OF THE INVENTION

Therefore the object of the present invention is to overcome all the aforesaid drawbacks and to indicate a rolling process and relating devices adapted to carry out it, so as to overcome the limits of each type of rolling mill described above, therefore to obtain a rolling mill having high productivity which is characterized, however, by a high quality standard of the pipe produced.

It is the object of the present invention a process of rolling hollow bodies in a longitudinal, multi-stand rolling mill of the continuous, restrained type, the rolling mill comprising a main rolling mill (2) and an extracting rolling mill (4) in line and downstream of the main rolling mill, said main rolling mill and extracting rolling mill being adapted to process the hollow body cooperating with at least one spindle (5), the process comprising the following steps:

- positioning said extracting rolling mill at a distance from said main rolling mill larger than the maximum length of the hollow body and of the spindle;
- extracting the spindle at the outlet of said main rolling mill in the gap between said main rolling mill and extracting rolling mill, and unloading it laterally.

It is also an object of the present invention a rolling mill to carry out the process.

It is a particular object of the present invention a rolling process and associated longitudinal, multi-stand rolling mill of the continuous, restrained type for hollow bodies, as better described in the claims forming an integral part of the present description.

BRIEF DESCRIPTION OF THE DRAWINGS

Further objects and advantages of the present invention will become apparent from the following detailed description of an embodiment thereof (and of its variants), and from the accompanying drawings provided by way of mere non-limiting example, in which:

FIGS. 1.1, 1.2, 1.3 show a layout diagram of the rolling mill object of the present invention during three successive processing steps;

FIGS. 4.1, 4.2, 4.3 show sectional views of an embodiment of the catching device, namely side, top and cross-sectional views, respectively.

The same reference numbers and letters in the drawings identify the same elements or components.

DETAILED DESCRIPTION OF THE EMBODIMENTS

Figure 2:
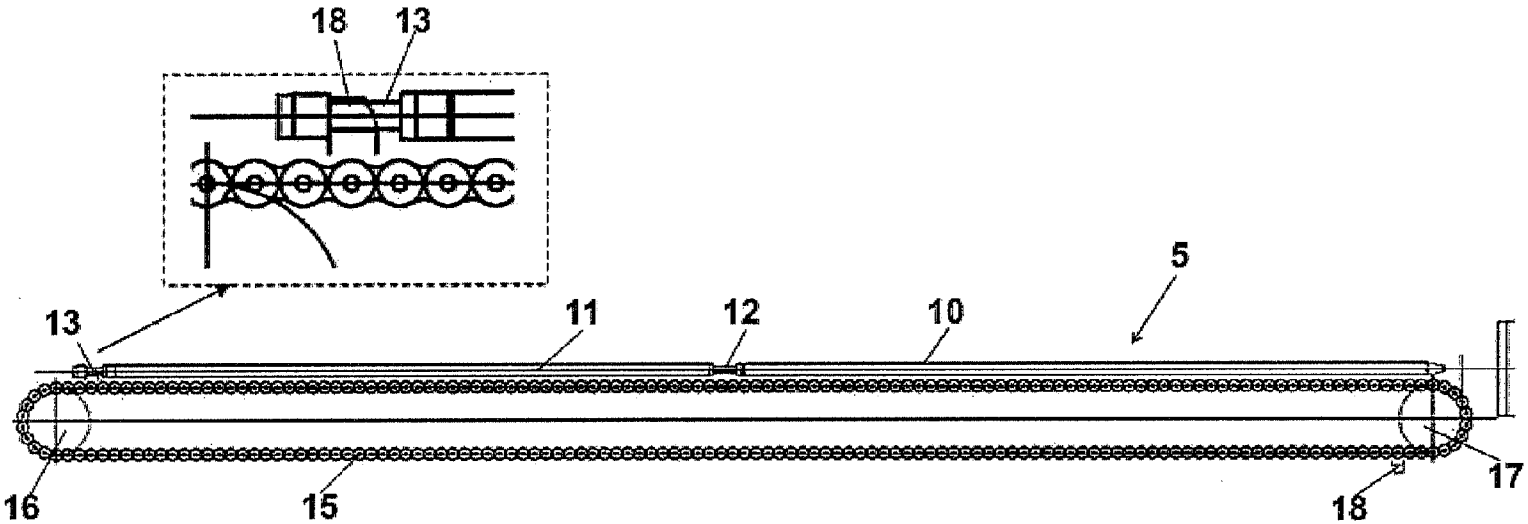
FIG. 2 shows the inlet system in FIG. 1, in greater detail.

According to the main aspects of the present invention, the longitudinal, multi-stand rolling mill mainly includes (see FIGS. 1.1, 1.2, 1.3) an inlet system 1 for pipe and spindle, followed by a rolling mill 2, downstream of which is an outlet system 3 for pipe and spindle, and finally an extracting rolling mill 4 placed at a distance from the rolling mill 2 larger than the maximum length possible for the pipe being processed and for the spindle.

More precisely, the distance between the axis of the last stand of the rolling mill 2 and the axis of the first stand of the extracting rolling mill 4 is the distance between rolling mill 2 and extracting rolling mill 4.

Thereby, when the pipe is released from the rolling mill 2, the pipe is not yet engaged with the extracting rolling mill 4, thus allowing the inlet speed of the pipe into the extracting rolling mill to be independent from the outlet speed from the rolling mill, and thus possibly ending processing the pipe in line. The spindle is extracted at the outlet of the rolling mill 2 by means of the outlet system 3, laterally unloaded and then brought back to the inlet out of line, without interrupting the pipe processing. Moreover, during this step of returning the spindle out of line, the processing cycle of the next pipe may begin by using another spindle. In the meantime, the preceding spindle is repositioned on the inlet system for successive processing, thus being exchanged with the previous one. Normally, to be precise, the circulating spindles are more than two as each spindle between one rolling and the following requires to be cooled down and lubricated (these operations are known and are not the object of the present invention).

Indicative sizes for the rolling mill object of the invention may be the following:

inlet system: 24 m
rolling mill: 8 m
outlet system: 34 m
spindle: 24 m
hollow input piece: max 10.5 m
output pipe: max 30 m The sizes are given by way of example and serve to better understand the rolling mill described. Obviously, they should not be considered as a characterizing limit of the rolling mill.

In FIGS. 1.1, 1.2, 1.3, the three successive processing steps are indicated: a step with spindle 5 on the inlet system 1 (FIG. 1.1); crossing step of the spindle in the rolling mill 2 (FIG. 1.2); step with the spindle on the outlet system 3 (FIG. 1.3). In the figures, the pipe is not indicated for simplicity, while the spindle 5 is indicated (with greater detail in FIG. 2) comprising a processing head 10, followed by an extension 11, alternated by an intermediate compartment 12 having a smaller diameter, while a tang 13 is in the tail.

The slot 12 is obtained in one piece from the extension 11 or, alternatively it could be obtained on an intermediate piece between the processing head 10 and the extension 11.

Hereinafter a non-limiting embodiment of the rolling mill is described, which is also useful for understanding the processing process, which is a particular object of the present invention.

Inlet System of the Rolling Mill

The inlet system 1 is provided at the inlet of the rolling mill and comprises a spindle restraining device which, in the suggested embodiment (FIG. 2), consists of a chain 15, with two star-pulleys 16, 17 at the two ends, and comprising at least two supporting pieces 18 (at an equal reciprocal distance on the chain) which are alternatively engaged (in two successive rolling operations) with the tang 13 of the spindle extension (box in FIG. 2). The chain system is known per se, e.g. such as that existing in the rolling mills of semi-restrained type described above.

Such an inlet system permits to automatically release the tang of the spindle from the supporting piece in a fixed position, when the supporting piece itself winds on the star-pulley 17 arranged close to the inlet side of the rolling mill. The chain is motorized and its speed and position are controlled (the control is not shown for simplicity in the drawings). Once the tang 13 has been freed, the chain stops in such a position that the second supporting piece is in correspondence of the tang of the new spindle which is loaded by means of an aerial manipulator of known type (not shown). To shorten the cycles, the spindle is preferably loaded at the is inlet of the rolling mill already pre-inserted into the pipe to be rolled.

True Rolling Mill

The rolling mill 2 consists of a series of motorized rolling stands, alternated in groups by spindle-holder stands. A descaling system outside the pipe may be provided upstream of the first stand. A last rounding stand may exist downstream. The morphology of the rolling mill is of known type; the number and type of stands is not a characterizing object of the invention.

Outlet of the Rolling Mill

Figure 3:
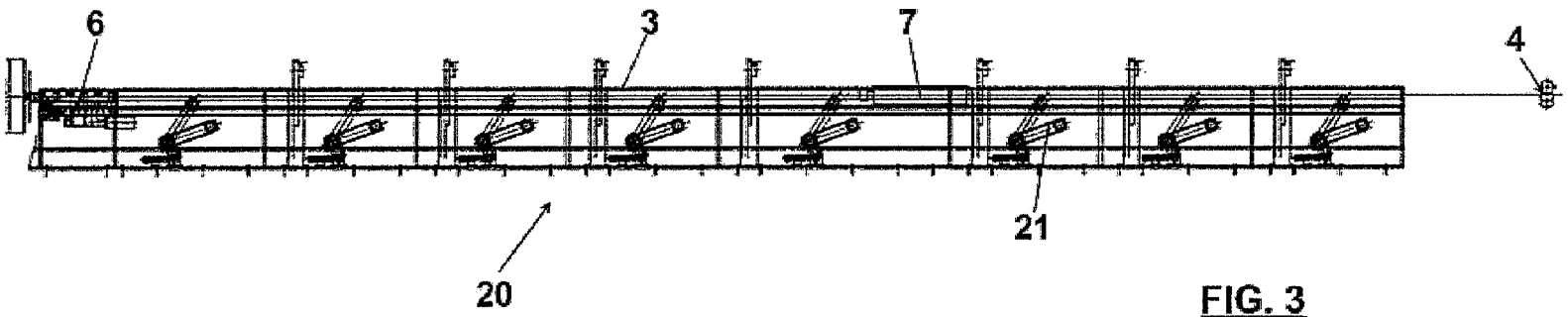
FIG. 3 shows the outlet system in FIG. 1, in greater detail.

The outlet system 3 comprises (FIG. 3) a motorized roller path 20, which may be partially pulled down, comprising a series of rollers 21 to support the pipe and the spindle.

Moreover, a movable catching device 6 and a fixed dampened stopping device 7 are provided and described below.

Each roller of the motorized roller path which may come in contact with the catching device 6 is of the pulling down type by means of hydraulic systems or other systems all known per se. An example is described hereinafter.

The section of rollers which may be pulled down starts from the outlet of the rolling mill 2 and may end at the stopping position of the catching device 6 against the fixed, dampened stopping device 7.

The next section up to the extractor 4 may be fixed, e.g. in the case of a system with a single nominal size (calibre) at the outlet of the rolling mill.

Guide tracks of the catching device 6 and fixed racks which engage the toothed wheels mounted to the catching device, are by the side of the roller path. An example is described hereinafter.

The rolling mill according to the invention is a rolling mill of restrained type, in which the pipe rolling occurs at a calculated, set speed of the spindle, in which when the tail of the pipe is released from the last stand of the rolling mill 2, the pipe is not yet engaged with the extracting rolling mill 4, as the first stand of the extractor is at a distance from the last stand of the rolling mill 2 larger than the maximum length of the producible pipe.

As mentioned above, this condition permits to render the inlet speed of the extractor independent from the outlet speed of the rolling mill.

When the pipe leaves the last stand of the rolling mill 2, it is brought to the spindle speed, which is also synchronized with the input speed of the extractor and with the speed of the motorized roller path 20 between the rolling mill and the extractor. At the same time, the catching device 6, in a stationary position just downstream of the rolling mill 2, is accelerated and brought into synchrony with the speed of the spindle. The position of the spindle is known, as the restraining device placed on the inlet side of the rolling mill 2 is still engaged with the tang 13 at the tail end of the spindle extension.

At this point, the catching device 6 is engaged with the intermediate compartment 12 arranged on the extension close to the connection point between the extension and the working part of the spindle.

Therefore, a sort of relay occurs between the restraining device and the catching device, with the control of the spindle motion passing from the first to the second. Once the extension of the spindle has been caught, the catching device 6 continues its stroke while withdrawing the extension from the rolling mill 2 and bringing the spindle (working part and extension) to a fixed unloading position between the rolling mill and the extractor (the total length of the spindle is less than the distance between the rolling mill 2 and the extractor 4).

During this step, spindle and pipe travel synchronously, i.e. at an equal speed. The catching device 6 is decelerated in a fixed predetermined position, with the aid of the dampened stopping device 7. In this step, an axial extracting force is created, which is exerted on the pipe by the extracting rolling mill 4, while the catching device is restrained by the dampened stopping device. This solution prevents the motorization of the catching device from being oversized.

The fixed, dampened stopping device absorbs the kinetic energy of the catching device and of the spindle connected thereto, and exerts the reaction required to balance the pull exerted by the extractor.

The catching device 6 substantially stops in a fixed position as it progressively impacts with the dampened stopping device 7. The latter may essentially consists of, for example, two hydraulic cylinders suitably arranged on the two sides of the guide tracks of the catching device. These cylinders are characterized by a hydraulic braking system (not indicated).

The heads of the two pistons of the hydraulic cylinders are engaged with the structural part 43 of the catching device, adjacent to the position of the spindle, at an equal height, thus avoiding the occurrence of overturning actions on the cart of the catching device.

Once the extracting rolling mill 4 has withdrawn the pipe from the spindle 5, a rapid transversal unloading device laterally unloads the spindle, before the successive pipe arrives.

With reference to FIGS. 4.1, 4.2, 4.3, the catching device 6 substantially is a cart 40 which moves on wheels, on the rail 44 the tracks of which are placed at the two sides of the roller path. Six support wheels 41 and four counter wheels 42 serving an overturning preventing function are present in the embodiment.

The tracks on the unloading side of the spindle (FIG. 4.2) are interrupted in sections 46 to permit a series of rotating arms 45 (technically known) to pass, thus permitting the transversal evacuation of the spindle.

The presence of three wheels 41 with larger pitch than the compartment between a track and the next, always permits to have two wheels resting on the side where the interruptions 46 are provided.

In this embodiment, the cart 40 is motorized by means of two motors 48 connected to two pinions arranged at a vertical axis by means of reducers 49. Each pinion is engaged with two toothed wheels 51, the longitudinal pitch of which is always larger than the compartment on the spindle unloading side which interrupts the fixed counter-rack 52. The rack 53 on the opposite side is continuous.

The solution described permits an automatic mechanical phasing system of the two toothed wheels which are engaged with the discontinuous rack, thus permitting to automatically find the phase of the teeth again, when the toothed wheel is rolled on the rack downstream of an interruption 46.

A hooking device is mounted on the catching device which, in the example shown, is made in the form of an overturnable hinged guillotine group 55, between a lowered resting position and a working position, in which the guillotine 56 is engaged with the slot 12 arranged in the spindle extension.

In the embodiment, the guillotine group 55 is controlled by linkages 57 by means is of a reducer and an electric motor.

Alternatively, mechanical systems controlled by a cam fixed to the ground, or hydraulic systems may be used. In the latter case, it is necessary to supply oil or another fluid to control the guillotine on board the catching device.

The solution described has the advantage that, once the guillotine 56 has been brought to the working position, it rests at the two sides of the structure of the cart 40 thus avoiding to overload the linkages 57 during the step of extracting the pipe from the spindle.

The suggested solution leaves the upper side of the catching device completely free, this attention is normally operatively appreciated as it promotes interventions from above with a span crane or another lifting device.

The embodiment includes using a rotating arm system 45, for the transversal evacuation of the spindle, known per se in the art.

The rotating arm system 45 is developed on the unloading side of the spindle over the competent section of the length of the spindle, at the stopping and evacuation position of the spindle itself.

The system substantially provides for the arm 45 rotating about a pivot 50, so as to always keep the plate 47 which supports the spindle 5 with the same inclination. The arm lifts the spindle from the bottom, starting from the lowered position underneath, lifts it and transports it transversally out of the roller path, while stopping in the lateral position, from where the spindle is then taken by a system (not shown in the drawings and not described in detail as known per se), and then brought towards the inlet system 1. The rotating arm completes its rotation and is brought back to the waiting position under the roller path and out of interference with the catching device 6, which may reversely transit to position itself at the starting point again for the next rolling cycle.

An example of motorized roller 21 of the roller path is shown in FIGS. 4.1 and 4.3.

The roller 21 may take the lowered position 21.1 or the raised position 21.2, being controlled by a pulling down system 62 with linkages 65 by means of the actuator 67, which rotate the arm 60 of the roller. Instead, a motor 64 with associated chains 66 and 63 controls the rotation of the roller.

The advantages resulting from the application of the present invention are apparent.

The cycle time of the system permits the production of 3-4 pieces per minute.

An advantage of the invention is that as the speeds of the rolling mill and of the extractor are free, the extractor may also serve the function of calibrator (or possibly of stretch reducing mill) by directly finishing the pipes in line without intermediate fossil heating.

A possible induction furnace may be inserted in this case between the unloading position of the spindle and the extracting rolling mill.

The rolling mill according to the invention includes a rounding stand downstream of the true rolling stands. Such a stand permits to withdraw the pipe from the spindle without difficulty, even if pipe and spindle were in contact for some seconds without relative speed; the contact time is greater in the case of short (normally thick) pipes.

As the extraction in line is provided, the temperature of the pipe along its axis is much more uniform than that obtained by the floating spindle and/or semi-restrained spindle processes, as in the latter the spindle is partially inserted into the pipe; therefore, the head of the pipe is much hotter than the tail, also because of the increased pipe-spindle contact time due to the out-of-line withdrawal typically actuated with a chain and guillotine device.

Constructional variations of the non-limiting embodiment described are possible, without however departing from the scope of protection of the present invention, thus comprising all the equivalent embodiments to a person skilled in the art.

A person skilled in the art is able to implement the object of the invention from the description indicated above, without introducing further constructional details.

The invention claimed is:

1. A longitudinal multi-stand rolling mill for hollow bodies comprising:

a main rolling mill defining a longitudinal traversal axis of the hollow body when the hollow body is disposed in the main rolling mill;

an extracting rolling mill defining a longitudinal traversal axis of the hollow body when the hollow body is disposed in the extracting rolling mill, wherein the longitudinal axes of the main and extracting rolling mills are in line with other, and the extracting rolling mill is downstream with regard to the main rolling mill, said main rolling mill and said extracting rolling mill being able to process the hollow body cooperating with at least one spindle, said extracting rolling mill being placed at a distance from said main rolling mill larger than a length of the hollow body and of the spindle so that the spindle and hollow body are released from both the main and extracting rolling mills when the spindle and hollow body exit the main rolling mill;

means for extracting the spindle from the hollow body when the spindle and hollow body are released from both the main and extracting rolling mills and disposed therebetween, and unloading the spindle laterally, wherein said means for extracting the spindle at the outlet of said main rolling mill and unloading the spindle laterally comprise:

means for catching said spindle synchronizing a speed of the hollow body and of the spindle at the outlet of said main rolling mill with a speed at the inlet of said extracting rolling mill, wherein said means for catching said spindle comprise a catching device comprising a motorized cart moving in parallel to said motorized roller path and an overturnable hooking device to catch the spindle during its travel and to release it when it stops;

means for decelerating said spindle until the spindle stops so that spindle is detached from the hollow body which, once the hollow body exits the main rolling mill, the hollow body enters said extracting rolling mill, means for laterally unloading said spindle while the spindle is disposed between the main and extracting rolling mills;

a motorized roller path, which can be partially pulled down, in the gap between said main rolling mill and said extracting rolling mill for supporting the pipe and the spindle.

2. Longitudinal rolling mill according to claim 1, wherein said means for decelerating said spindle until it stops comprise a dampened stopping device to progressively stop the travel of said catching device.

3. Longitudinal rolling mill according to claim 2, wherein said means for unloading said spindle transversally to the resting position comprise a rotating arm system for lifting the spindle in its resting position when said overturnable hooking device releases the spindle, and for bringing it in a transversally external position.

* * * * *